United States Patent [19]

Brooker et al.

[11] Patent Number: 4,599,242

[45] Date of Patent: Jul. 8, 1986

[54] REFRACTORY SLIDEGATE WITH COUNTERSUNK HOLE AND METHOD

[75] Inventors: Arnold S. Brooker; Jay F. Schnackel, both of Whitehouse, Ohio

[73] Assignee: Plasmafusion, Inc., Wyandotte, Mich.

[21] Appl. No.: 711,048

[22] Filed: Mar. 12, 1985

Related U.S. Application Data

[62] Division of Ser. No. 533,515, Sep. 19, 1983.

[51] Int. Cl.[4] ..... B05D 1/08

[52] U.S. Cl. ..... 427/34; 427/423

[58] Field of Search ..... 427/34, 423; 222/600

[56] References Cited

U.S. PATENT DOCUMENTS

| | | | |
|---|---|---|---|
| 3,685,707 | 8/1972 | Shapland | 222/559 |
| 3,801,083 | 4/1974 | Mantey et al. | 266/38 |
| 3,841,539 | 10/1974 | Shapland et al. | 222/561 |
| 4,003,561 | 1/1977 | Cudby | 266/220 |
| 4,096,976 | 6/1978 | Daussan | 222/591 |
| 4,173,685 | 11/1979 | Weatherly | 428/556 |
| 4,179,046 | 12/1979 | Jeschke et al. | 222/600 |
| 4,182,466 | 1/1980 | Fehling et al. | 222/600 |
| 4,257,543 | 3/1981 | Muschner et al. | 222/600 |
| 4,288,495 | 9/1981 | Terner et al. | 428/446 |
| 4,357,387 | 11/1982 | George et al. | 428/246 |

FOREIGN PATENT DOCUMENTS

| | | | |
|---|---|---|---|
| 1116829 | 1/1982 | Canada . | |
| 1910707 | 9/1970 | Fed. Rep. of Germany . | |
| 2816283 | 10/1978 | Fed. Rep. of Germany | 427/423 |
| 7027076 | 4/1971 | France . | |
| 165559 | 12/1981 | Japan . | |

*Primary Examiner*—John H. Newsome

*Attorney, Agent, or Firm*—Jeffers, Irish & Hoffman

[57] ABSTRACT

A slidegate assembly is provided for use with a ladle wherein at least one of the slidegates has a recess countersunk about an opening in its surface in sliding engagement with the other slidegate, and has an insert made of a refractory material sprayed in the recess by a plasma gun device. The insert has an opening aligned with the opening in the slidegate, and is substantially coplanar with the sliding surface. In the closed position, the insert closes the opening of the other slidegate. The refractory material applied by the liquid stabilized plasma gun device provides an extremely hard insert that is highly resistant to the temperatures and erosive effects of various molten melts and to the abrasive effects caused by multiple shifts of the assembly during pouring operations. A method is provided for producing slidegates for the assembly.

10 Claims, 7 Drawing Figures

REFRACTORY SLIDEGATE WITH COUNTERSUNK HOLE AND METHOD

This a division of application Ser. No. 533,515, filed Sept. 19, 1983.

BACKGROUND OF THE INVENTION

This invention pertains to a slidegate assembly and method for use with foundry ladles, steel mill ladles, and the like for regulating the flow of molten melt.

Slidegate assemblies, which are one of the more commonly used methods for metering the flow of molten melt, generally comprise a stationary plate having an opening therein and secured to the ladle to align the opening with the outlet in the ladle. A second slidegate is slidably mounted against the stationary slidegate and is slidable between an open position wherein an opening in the second slidegate is aligned with the opening in the stationary slidegate, and a closed position wherein the second slidegate is moved to close the opening in the stationary slidegate. Due to corrosive and, particularly, erosive effects, high temperatures, and the like of the molten melt, the slidegates are generally made of a heat-resistant material, such as fireclay. Though made of a heat-resistant material, the slidegates are generally useable for only one pouring operation and then must be replaced because of erosion or cracking caused by the molten melt. Erosion of the slidegates, particularly about their openings, precludes a satisfactory fluid-tight seal between the slidegates, and any cracks will eventually travel to the peripheries of the slidegates and cause leaking of the melt.

Various attempts to provide slidegates resistant to the effects of molten melts include manufacturing each of the slidegates of an extremely hard refractory material more resistant to the erosive effects of molten melt than fireclay. However, one of the drawbacks with these slidegates is that the refractory material of which they are made is extremely expensive, and for that reason are undesirable.

Another method attempted to improve the resistance of slidegates to the effects of the molten melt includes coating slidegates made of fireclay or the like with an extremely hard refractory material, such as zirconium silicate, corundum, or the like. One of the problems with this is that the means for adhering or bonding the coating to the slidegate is generally not sufficient to withstand the extremely high temperatures and erosive effects of the molten melt during multiple pouring operations. These coatings tend to chip or break off due to the failure of the adhesive or bonding technique utilized. Further, once a crack develops in the coating, it will eventually travel to the edge of the coating, thereby causing leaking of molten melt.

Moreover, should only portions of the sliding surfaces near their openings be coated with the hard refractory material, the loss of flatness or planarity of the sliding surfaces due to the partial coating can cause leakage during sliding movement between the open and closed positions.

SUMMARY OF THE INVENTION

The present invention overcomes the problems and disadvantages of the above slidegates by providing an improved refractory slidegate assembly and method for ladles. The slidable slidegate is provided with a recess countersunk about its opening, and an insert made of an extremely hard refractory material is disposed in the recess to provide a complete seal about the opening. The insert is substantially coplanar with the top surface of the slidable slidegate to maintain the flatness or planarity thereof, thereby maintaining the fluid-tight seal with the stationary slidegate, and precluding possible leakage of molten melt when the slidegate assembly is operated between the open and closed positions.

Moreover, should a crack develop in the insert and travel toward the outer extremity thereof during pouring operations, further development of the crack will cease at the interface of the insert and the base material of which the slidegate is made, thereby permitting continued use of the slidegate assembly for a limited number of pouring operations before requiring replacement. The wall of the recess in the slidegate is effective to halt or delay further cracking to permit continued use of the slidegate assembly.

The extremely hard refractory material of which the insert is made is applied in the recess by a plasma gun device, and preferably a liquid stabilized plasma gun device, to improve the bond between the particles of the insert material, and between the base material of which the slidegate is made and the insert material. The bond created thereby is not of a typical adhesive nature, but rather a physical-chemical bond between particles and materials. By applying the insert material in the recess with a plasma gun device to improve its bonding to the base material of the slidegate, the slidegate assembly is capable of being used for numerous pouring operations due to the reduction of erosion and spalling of the insert caused by molten melt.

In one form of the invention there is provided an improved slidegate assembly comprising a stationary slidegate having a downwardly facing bottom surface and an opening extending therethrough and which is adapted to be connected to a ladle with the opening aligned with the ladle outlet. A second slidegate has an upwardly facing top surface with an opening extending therethrough and a recess countersunk about the opening in the top surface. An insert is disposed in the recess and is substantially coplanar with the top surface of the slidegate and has an opening aligned with the opening in the second slidegate. The two slidegates are joined together such that the top surface of the second slidegate is in slidable engagement against the bottom surface of the stationary slidegate between an open position wherein the openings in the slidegates and insert are aligned, and a closed position wherein the insert closes the opening in the stationary slidegate.

It is an object of the present invention to provide an improved slidegate assembly and method for ladles and the like for regulating the flow of molten melt therefrom.

Another object of the present invention is to provide an improved slidegate assembly and method for ladles and the like which can be used for more than one pouring operation.

Yet another object of the present invention is to provide an improved slidegate assembly and method for ladles and the like which substantially eliminates leakage between the slidegates. during multiple pouring operations.

A further object of the present invention is to provide an improved slidegate assembly and method for ladles and the like wherein an insert made of an extremely hard refractory material is disposed in a recess countersunk about the opening in the surface of the slidable slidegate in engagement with the stationary slidegate.

A still further object of the present invention is to provide an improved slidegate assembly and method for ladles and the like wherein the insert is disposed in the recess by spraying the insert material with the effluent of a liquid stabilized plasma gun device.

Further objects of the present invention will appear as the description proceeds.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF PREFERRED EMBODIMENTS

Figure 1:
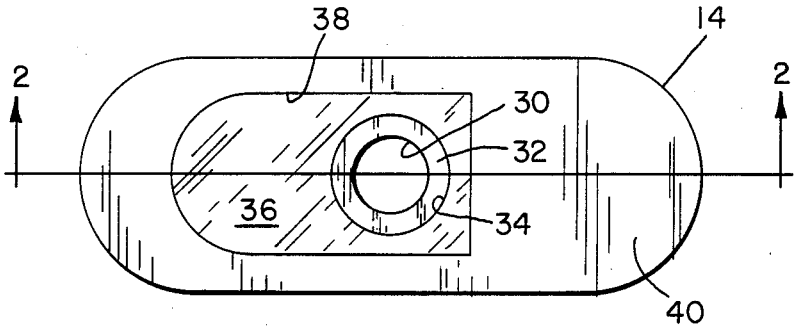
FIG. 1 is a top plan view of a slidegate of the present invention.
Figure 2:
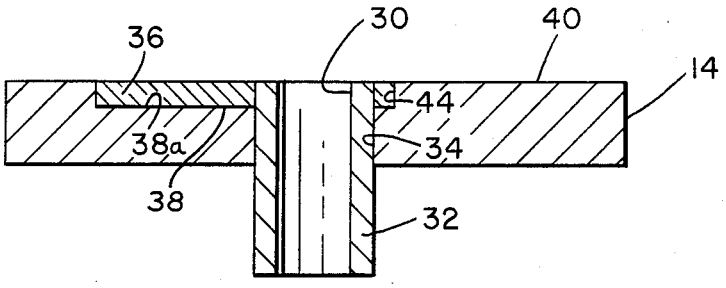
FIG. 2 is a sectional view of FIG. 1 taken along line 2—2 and viewed in the direction of the arrow.

Referring to FIGS. 1–4 slidegate assembly 10 comprises slidegate 12 and slidegate 14 held in fluid-tight slidable engagement by means known in the art. Slidegate 12 is conventionally connected to ladle 16 and has its opening 18 aligned with outlet 20 of ladle 16. Slidegates 12, 14 are generally made of fireclay.

Opening 18 is defined by collector 22 tightly fitted in hole 24 in slidegate 12, and recess 26 has insert 28 disposed therein. Similarly, slidegate 14 has opening 30 defined therein by collector 32 tightly fitted in hole 34, and insert 36 is disposed in recess 38. Recesses 26, 38 can be countersunk in slidegates 12, 14, respectively, by machining, or slidegates 12, 14 can be formed with recesses 26, 38, respectively, countersunk therein.

Collectors 22, 32, and inserts 28, 36 are made of the same or different ones of extremely hard refractory materials, such as the materials from the group of zirconium silicate, corundum, magnesium oxide, chromic oxide, magnesium carbonate, zirconium oxide, silicon dioxide, spinel, mullite, rutile, hafnium oxide, or mixtures thereof. Since the materials of which collectors 22, 32 and inserts 28, 36 are made are quite expensive, it is preferable that minimum amounts of those materials be used. Collectors 22, 32 are made of their respective materials in any suitable manner, such as by plasma spraying or sintering, and then are tightly fitted in respective holes 24, 34 such that they extend above the bottom surfaces 26*a* and 38*a*, respectively, of recesses 26 and 38.

One of the unique features of the present invention is the manner of disposing inserts 28, 36 in respective recesses 26, 38. Since the manner of applying both inserts 28, 36 is identical, only a description of applying insert 36 in recess 38 will be given. Initially, recess 38 is countersunk in slidegate 14, and a suitable depth therein is 0.030–0.035 inches, although a greater or lesser depth can be used and will depend upon the type of material used and conditions existing during a particular pouring operation. After recess 38 has been countersunk in slidegate 14, the particular refractory material chosen is sprayed in recess 38 by means of a liquid stabilized plasma gun device, such as that disclosed in U.S. Pat. No. 4,338,509 issued July 6, 1982 to Vysoka skola chemicko-technologicka of Prague, Czechosolvakia, which patent is incorporated by reference herein. The plasma gun device disclosed therein generates an effluent having a concentration of charged particles between about $2.00\times10^{24}$ and $0.3\times10^{23}$ per cubic centimeter in number and a temperature between about 15,000° K. and 60,000° K. However, it should be understood that other plasma gun devices may be used, some of which are stabilized by two or more liquids. Insert 36 thus applied in recess 38 is extremely hard and the bond between the insert material and slidegate material is extremely strong due not only to the inherent chemical characteristics of the refractory material, but also because of the high concentration of particles and high temperature of the plasma gun device effluent, which creates the extremely strong physical-chemical bond between particles of the sprayed material and the slidegate material. Recess 38 is generally filled above the level of surface 40 of slidegate 14, and insert 36 is thereafter ground and polished to be coplanar with surface 40 and collector 32.

The depth with which recess 38 is countersunk in surface 40 is dependent upon the desired thickness of insert 36, and is countersunk to a depth equal to the desired thickness of the insert. Again, the thickness of insert 36, and the depth of recess 38, will vary depending upon the refractory material used and the conditions existing with a particular type of pouring operation. Furthermore, the shape or geometry of recess 38, as well as recess 26, can vary depending upon requirements of the pouring operations, types of molten melt, and other parameters.

Figure 3:
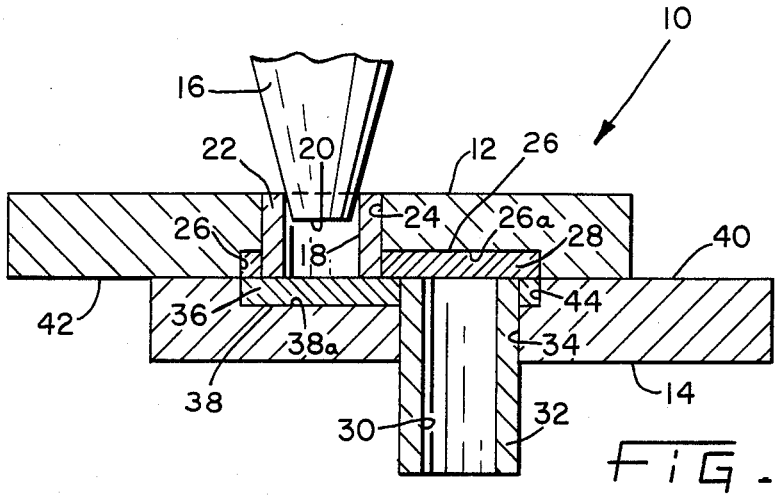
FIG. 3 is a partially broken-away side elevational view in section of one embodiment of the present invention in the closed position.
Figure 4:
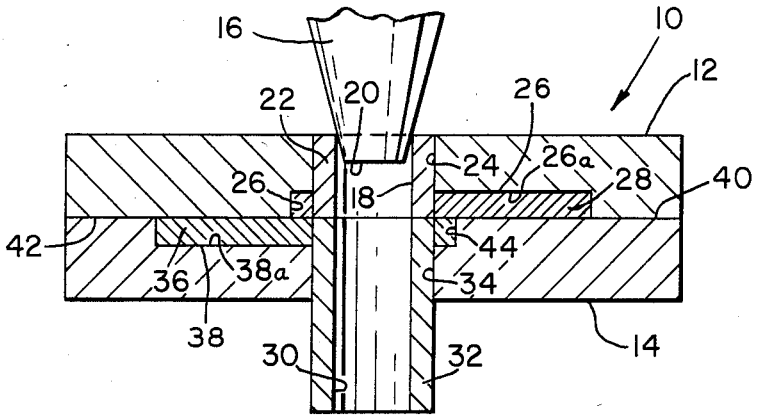
FIG. 4 is similar to FIG. 3 with the embodiment in the open position.

In an identical manner, insert 28 is disposed in recess 26 of slidegate 12, and the positions of recesses 26, 38 in their respective slidegates 12, 14 are as illustrated in FIGS. 3 and 4. FIG. 3 illustrates slidegate assembly 10 in the closed position such that opening 18 is closed by insert 36 and opening 30 is closed by insert 28. FIG. 4 illustrates the slidegate assembly 10 in the open position to allow molten melt to flow from ladle 16 through openings 18, 30.

Since collectors 22, 32 may eventually tend to crack, they will naturally require replacement. This is simply accomplished by punching collector 22 or collector 23 from its respective hole 24, 34 and replacing it with a similar collector. If any cracks or gaps exist between the new collector and its respective insert, the gap or crack is filled by the insert material sprayed with the plasma gun device.

As described, inserts 28, 36 provide a substantially fluid-tight seal between surface 40 of slidegate 14 and surface 42 of slidegate 12, and permit slidegate assembly 10 to be used for more than one pouring operation. This is possible due to the fact that should a crack develop in insert 36, for example, the crack will eventually extend to the outer periphery thereof and be temporarily halted by upstanding wall 44 of recess 38; wall 44 representing the vertically disposed interface between insert 36 and slidegate 14. Furthermore, since inserts 28, 36 are applied by spraying the refractory material of which they are made with a plasma gun device, the bond between inserts 28, 36 and there respective recesses 26, 38 is extremely strong, thereby permitting further multiple uses of slidegate assembly 10.

Figure 5:
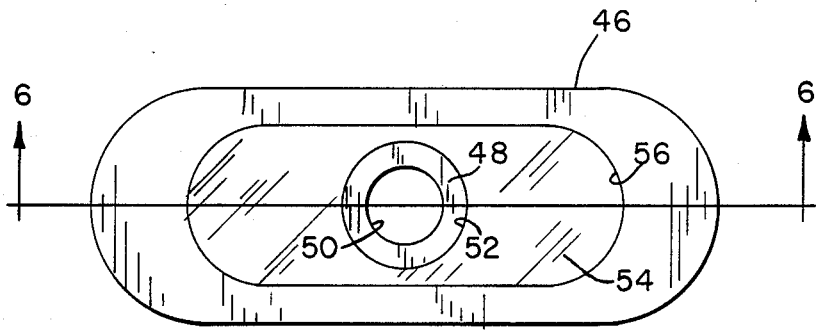
FIG. 5 is a top plan view of another slidegate of the present invention.
Figure 6:
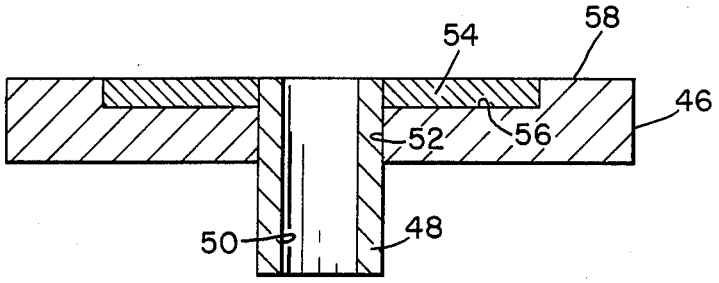
FIG. 6 is a sectional view of FIG. 5 taken along line 6—6 and viewed in the direction of the arrows.

Referring now to FIGS. 5 and 6, slidegate 46 of a second embodiment of the present invention is illustrated and comprises collector 48 having opening 50 therein and tightly fitted in hole 52, and insert 54 disposed in recess 56 countersunk in surface 58 about hole 52. Insert 54 is similar to inserts 28, 36 in that it is made of an extremely hard refractory material and applied in recess 56 by spraying the refractory material with the effluent of a liquid stabilized plasma gun device. As can be seen in FIGS. 5 and 6, insert 54 is symmetrically disposed about hole 50 to allow it to slide to the left or right to close the opening of a similar stationary slidegate (not shown). Since the closing of the opening of the stationary slidegate can be accomplished by sliding slidegate 46 to either the left or right of the opening of the stationary slidegate, this second embodiment of the present invention permits even further multiple uses of the assembly in pouring operations.

As described, the slidegate assembly 10 can be used in various pouring operations. For example, assembly 10 can be used with foundry ladles that typically contain 50 tons of molten melt, or a larger constructed assembly 10 can be used with steel mill ladles typically containing 250 tons of melt. The melts can be aluminum, copper, steel, and the like.

Figure 7:
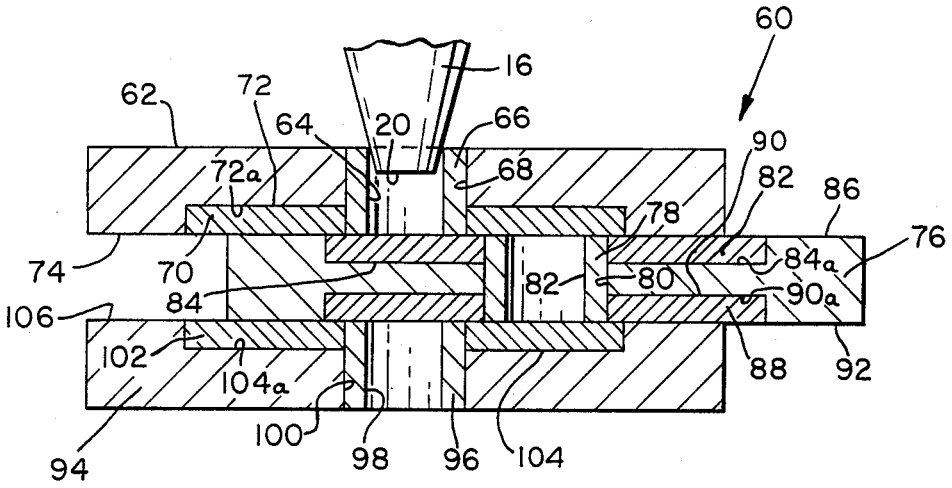
FIG. 7 is a partially broken-away side elevational view in section of a second embodiment of the present invention in the closed position.

Although assembly 10 has been described as comprising only two slidegates, the present invention contemplates other assemblies of three or more slidegates, such as a continuous cast flow slidegate assembly wherein the molten melt continuously flows from a ladle having a two slidegate assembly to a tundish having a three slidegate assembly and thence to a caster mold. Referring to FIG. 7, slidegate assembly 60 includes a stationary slidegate 62 having an opening 64 in which ladle 60 is disposed so as to align outlet 20 with opening 64. Slidegate 62 further includes collector 66 tightly fitted in hole 68, and insert 70 disposed in recess 72 in bottom surface 74. A slidable slidegate 76 is slidably engaged against bottom surface 74 in a fluid-tight manner, and includes collector 78 tightly fitted in hole 80, collector 78 having opening 82 therein. Slidegate 76 further includes insert 82 disposed in recess 84 in top surface 86, and insert 88 disposed in recess 90 of bottom surface 92. A third and stationary slidegate 94 is slidably engaged against the bottom surface 92 of slidegate 76 in a fluid-tight manner, and includes collector 96 with opening 98 tightly fitted in hole 100, and insert 102 disposed in recess 104 of top surface 106. Inserts 70, 82, 88, 102, are disposed in their respective recesses 72, 84, 90, 104 and collectors 66, 78 and 96 extend above the respective bottom surfaces 72*a*, 84*a*, 90*a* and 104*a* of recesses 72, 84, 90 and 104, as described above. Openings 64 and 98 of stationary slidegates 62, 94 are axially aligned, and when slidegate 92 is moved to the left to the open position to align opening 82 with openings 64, 98, molten melt then flows from ladle 16 through outlet 20 and openings 64, 82, 98. Slidegate assembly 60 can be closed by sliding slidegate 76 to either the left or right position as indicated in FIG. 7. In the closed position, opening 64 of slidegate 62 is closed by insert 82 of slidegate 76, opening 82 of slidegate 76 is closed by inserts 70, 102 of slidegates 62, 94, and opening 98 of slidegate 94 is closed by insert 88 of slidegate 76.

While this invention has been described as having a preferred embodiment, it will be understood that it is capable of further modifications. This application is therefore intended to cover any variations, uses, or adaptations, of the invention following the general principles thereof, and including such departures from the present disclosure as come within known or customary practice in the art to which this invention pertains and fall within the limits of the appended claims.

What is claimed is:

1. A method of producing a slidegate for a slidegate assembly for regulating the flow of molten melt comprising the steps of:

providing a slidegate having a substantially planar surface and an opening extending therethrough, countersinking a recess in the planar surface about the opening, said recess having a bottom surface, inserting a sleeve member of refractory material in the slidegate opening, said sleeve member extending through the slidegate and above the recess bottom surface, and spraying an insert of a refractory material in the recess around the sleeve member to substantially completely fill the recess, the insert and sleeve member having upper surfaces that are substantially coplanar with said planar surface.

2. The method of claim 1 wherein the insert is disposed in the first recess by spraying the refractory material in the recess with a plasma gun device.

3. The method of claim 2 wherein the refractory material is selected from the group consisting of zirconium silicate, corundum, magnesium oxide, chromic oxide, magnesium carbonate, zirconium oxide, silicon dioxide, spinel, mullite, rutile, hafnium oxide, and mixtures thereof.

4. The method of claim 3 further including the step of grinding the insert to be coplanar with the planar surface of the slidegate.

5. the method of claim 1 including providing a second substantially planar surface substantially parallel to the first mentioned planar surface and having the opening extending therethrough, the sleeve member being substantially coplanar with the second planar surface, countersinking a second recess in the second planar surface about the opening, and spraying a second insert made of a refractory material in the second recess.

6. The method of claim 5 wherein the inserts are disposed in their respective recesses by spraying the refractory material in the respective recesses with a plasma gun device.

7. The method of claim 6 wherein the refractory material is selected from the group consisting of zirconium silicate, corundum, magnesium oxide, chromic oxide, magnesium carbonate, zirconium oxide, silicon dioxide, spinel, mullite, rutile, hafnium oxide, and mixtures thereof.

8. The method of claim 6 wherein the plasma gun device is a liquid stabilized plasma gun device.

9. The method of claim 5 further including the step of grinding the inserts to be substantially coplanar with the respective planar surfaces.

10. The method of claim 9 wherein the plasma gun device is stabilized by a plurality of liquids.

* * * * *